United States Patent [19]

Jäggle et al.

[11] 4,363,446

[45] Dec. 14, 1982

[54] FUEL INJECTION NOZZLE

[75] Inventors: Günther Jäggle, Stuttgart; Ernst Lang, Gerlingen; Heinrich Knapp, Leonberg, all of Fed. Rep. of Germany

[73] Assignee: Robert Bosch GmbH, Stuttgart, Fed. Rep. of Germany

[21] Appl. No.: 234,143

[22] Filed: Feb. 13, 1981

[30] Foreign Application Priority Data

Feb. 16, 1980 [DE] Fed. Rep. of Germany ..... 3005857

[51] Int. Cl.[3] ..... F02M 61/08

[52] U.S. Cl. ..... 239/453; 123/468; 239/533.3

[58] Field of Search ..... 239/452, 453, 456, 533.2–533.12; 123/462, 467, 468, 445, 446

[56] References Cited

U.S. PATENT DOCUMENTS

| | | | |
|---|---|---|---|
| 2,255,203 | 9/1941 | Wiegand | 239/453 X |
| 4,270,257 | 6/1981 | Kimata et al. | 239/453 X |
| 4,281,797 | 8/1981 | Kimata et al. | 239/533.12 |

FOREIGN PATENT DOCUMENTS

| | | | |
|---|---|---|---|
| 1212444 | 11/1970 | United Kingdom | 239/533.7 |

*Primary Examiner*—Andres Kashnikow
*Attorney, Agent, or Firm*—Edwin E. Greigg

[57] ABSTRACT

A fuel injection nozzle of the type which includes an outwardly opening valve needle of a valve group and an inner longitudinal bore connecting the valve group with a fuel inlet to the nozzle. The longitudinal bore includes a narrow section between two larger sections, the two larger sections being thus decoupled from pressure variations in either section.

2 Claims, 3 Drawing Figures

FUEL INJECTION NOZZLE

BACKGROUND OF THE INVENTION

The invention relates to a fuel injection nozzle having an outwardly opening valve at one end and a longitudinal bore connected to the valve end with a pressure line. Fuel is supplied to the longitudinal bore from the pressure line. The fuel flows through the longitudinal bore and is discharged from the nozzle by the valve.

In fuel injection nozzles of this type, which open outwardly and are used especially for low pressure injection, a chatter of the valve needle is preferred during operation in neutral gear or under low partial load, in order to obtain thereby a good concentration of the fuel on the one hand and an orderly sequence of injection on the other, independently of the load and the rpm. However, in the known fuel injection nozzles of the type noted above, over-oscillation associated with the chattering easily occurs, which leads to an uneven sequence of injection from stroke to stroke as well as to a possible interruption of the injection process and also to premature injections or after-injections.

Chattering typically refers to the characteristic noise produced by the nozzle valve during opening or closing. In the context of the present invention it also refers to the harmonic oscillations which the valve experiences when it is opened. This meaning is illustrated in FIGS. 1 and 2, which are discussed herein after.

OBJECT AND SUMMARY OF THE INVENTION

It is an object of the invention to improve the noted type of fuel injection nozzle so that the over-oscillations and their associated effects are avoided.

This object is achieved by partitioning the inner longitudinal bore of the nozzle to include a narrow section between two larger sections, the two larger sections being thus decoupled from pressure variations in either section.

The fuel injection nozzle according to the present invention has the advantage that, especially in neutral gear, small over-oscillations occur which do not lead to excessive oscillations. Therefore the injection sequence is smooth, especially in neutral gear and the lower area of partial load, and no premature injections or after-injections occur. The injection process is almost uninterrupted, i.e., there is either no contact or only minimal seating contact between the needle and the valve seat during injection. The invention is especially advantageous with a valve needle group having a long valve needle with only one guidance area on the side opposite the injection side and where it is comparatively difficult to obtain a favorable chattering effect.

The invention will be better understood and further objects and advantages thereof will become more apparent from the ensuing detailed description of a preferred embodiment taken in conjunction with the drawing.

DISCUSSION OF FIGS. 1 AND 2

Figure 1:
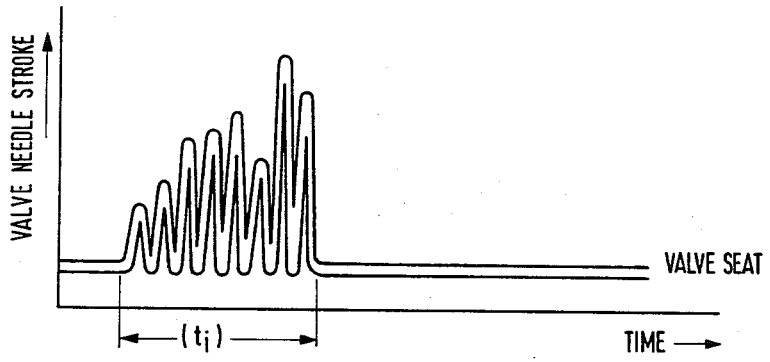
FIG. 1 is a graph of valve needle stroke vs. valve opening time, with undesirable chattering.
Figure 2:
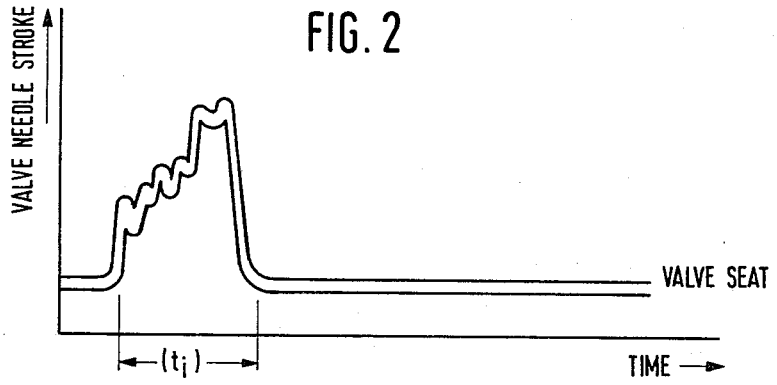
FIG. 2 is a graph of valve needle stroke vs. valve opening time, with desirable chattering.

Both FIGS. 1 and 2 depict test data illustrating the valve needle movement (stroke) during the injection period ($t_i$). The valve needle in FIG. 1, however, reacts by over-oscillating causing the needle valve to repeatedly engage its valve seat. This excessive oscillation or over-oscillation, and its associated consequences, is characteristic of the known fuel injection nozzles noted above; while the valve needle of FIG. 2 oscillates sufficiently to yield a good concentration of fuel without undesirable injection interruptions. The behavior of FIG. 2 is characteristic of fuel injection nozzles of the invention.

DESCRIPTION OF THE PREFERRED EMBODIMENT

Figure 3:
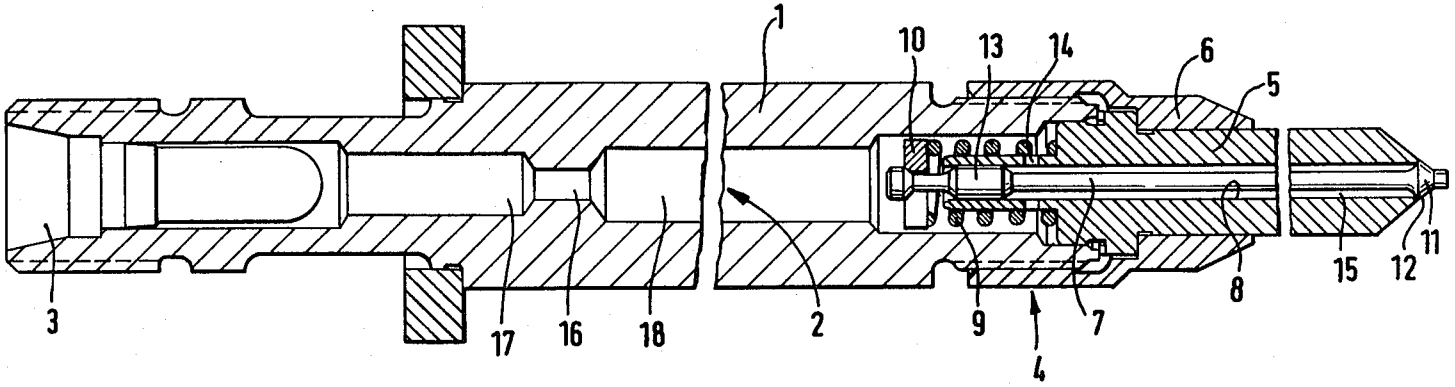
FIG. 3 illustrates an embodiment of the invention in the form of a partial cross sectional view through the nozzle which achieves the harmonic oscillation of FIG. 2.

The fuel injection nozzle of the invention as shown in FIG. 3 comprises a nozzle holder 1 in which an inner longitudinal bore 2 is defined. The bore 2 consists of several sections including an inlet 3, by way of which the fuel is brought to a valve group 4. The fuel is delivered to the inlet 3 by a pressure line, not shown. The fuel flows through the valve group 4 through which the fuel is injected into the combustion engine, also not shown.

The valve group 4 consists of a nozzle body 5, which is fastened to the nozzle holder 1 by means of a cap screw 6 of a valve needle 7. The valve needle 7 is partly guided in a bore 8 of the nozzle body 5 which forms an extension of the bore 2 of the nozzle holder 1. The valve needle 7 is biased in the closing direction by means of a closing spring 9, which stresses, by means of a spring plate 10, the head 11 of the valve needle 7 relative to the seat 12 of the nozzle body. A collar 13 is disposed on the shaft of the valve needle 7, which serves as a guide in the bore 8.

By way of radial bores 14 the fuel flows from the longitudinal bore 2 of the nozzle holder 1 into the annular chamber 15 formed by the valve needle 7 and the bore 8. Valve groups of this kind with only short guide collars have no great tendency to chatter, but they do, on the other hand, have other important advantages for injection.

In order to obtain the desired chattering, the inner longitudinal bore 2 is provided with sections of differing diameters. The middle section 16 has been embodied as relatively narrow and thereby acts as a throttle. By means of the throttle section 16, section 17, disposed toward the inlet 3, is decoupled from section 18, through which the flow proceeds after passing the throttle section 16 so that pressure line oscillations in section 17 are not carried over into section 18. This results in a certain control over the oscillations in section 18 to such an extent that there only occurs a reflection of the discharged pressure resulting from valve chatter oscillations in section 18 because of throttle 16, and only the desired small over-oscillation is produced. On the other hand, pressure waves coming from the area of the pressure line, through the throttle 16 are muffled so no excess oscillations occur.

It appears to be especially advantageous for there to be a ratio of the diameters of the three sections, that is, of sections 17, 16 and 18, from approximately 7:4:10. For section 18 a ratio of diameter to length of 1:8 up to 10 appears to be advantageous.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection nozzle for an internal combustion engine, having a nozzle holder defining an inner longitudinal bore through which fuel flows under pressure, one end of said longitudinal bore including a fuel inlet; and a valve group connected to the nozzle holder at the other end of the longitudinal bore, said valve group including a nozzle body and a valve needle which opens outwardly of the injection nozzle, the improvement wherein:

(i) the inner longitudinal bore includes three sections, one of which has a cross sectional area greatly reduced relative to the cross sectional area of the other two sections, said section of greatly reduced cross sectional area being situated between the other two sections and thus decoupling the other two sections from one another, so that pressure oscillations in either of said other two sections are substantially confined to that section; and (ii) the ratio of the cross sectional areas of the three sections is approximately 7:4:10.

2. In a fuel injection nozzle for an internal combustion engine, having a nozzle holder defining an inner longitudinal bore through which fuel flows under pressure, one end of said longitudinal bore including a fuel inlet; and a valve group connected to the nozzle holder at the other end of the longitudinal bore, said valve group including a nozzle body and a valve needle which opens outwardly of the injection nozzle, the improvement wherein:

(i) the inner longitudinal bore includes three sections, one of which has a cross sectional area greatly reduced relative to the cross sectional area of the other two sections, said section of greatly reduced cross sectional area being situated between the other two sections and thus decoupling the other two sections from one another, so that pressure oscillations in either of said other two sections are substantially confined to that section;

(ii) the cross sectional area of the section of the longitudinal bore on the fuel inlet side of the section of greatly reduced cross sectional area is smaller than the cross sectional area of the section of the longitudinal bore on the valve group side of the section of greatly reduced cross sectional area; and (iii) the diameter to length ratio of the section of largest cross sectional area is 1:8 to 1:10.

* * * * *